US006384584B2

(12) United States Patent
Sugano

(10) Patent No.: US 6,384,584 B2
(45) Date of Patent: May 7, 2002

(54) CURRENT CONTROL CIRCUIT

(75) Inventor: Kazuhiro Sugano, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/788,564

(22) Filed: Feb. 21, 2001

(30) Foreign Application Priority Data

Feb. 22, 2000 (JP) ..... 2000-044693

(51) Int. Cl.[7] ..... G05F 1/40
(52) U.S. Cl. ..... 323/282; 323/284; 323/285
(58) Field of Search ..... 323/282, 265, 323/284, 285

(56) References Cited

U.S. PATENT DOCUMENTS 5,570,004 A * 10/1996 Shibata ..... 323/303
5,977,758 A * 11/1999 Noguchi et al. ..... 323/283

FOREIGN PATENT DOCUMENTS

| | | |
|---|---|---|
| JP | 3-60319 | 3/1991 |
| JP | 5-6366 | 1/1993 |
| JP | 6-187055 | 7/1994 |

* cited by examiner

*Primary Examiner*—Peter S. Wong
*Assistant Examiner*—Gary L. Laxton
(74) *Attorney, Agent, or Firm*—Sughrue Mion, PLLC

(57) ABSTRACT

The PMOS transistor M1 is controlled by a time constant circuit 2 having a second resistor R2 and a capacitor C1 which are provided between a collector of the PNP transistor Q1 and the ground, and a hysteresis comparator 3, to which a voltage obtained by the time constant circuit 2 is applied, for controlling a gate of the PMOS transistor M1.

5 Claims, 3 Drawing Sheets

CURRENT CONTROL CIRCUIT

BACKGROUND OF THE INVENTION

1. Field of the Invention

The present invention relates to a current control circuit for detecting an overcurrent of a load and controlling a current flowing to the load.

2. Description of the Related Art

A conventional current control circuit will be described below with reference to FIGS. 4 and 5.

The current control circuit is constituted by a resistor R11 having one end to which an input terminal IN for inputting an output of a power source is connected, a PMOS transistor M11 having a source S connected to the other end of the resistor R11 and a drain D connected to an output terminal OUT to be coupled to a load, a PNP transistor Q11 having an emitter connected to the one end of the resistor R11, a base connected to the other end of the resistor R11 and a collector connected to a gate G of the PMOS transistor M11, and an NPN transistor Q12 having a base connected to a control terminal CTL, a collector connected to the source S and the gate G of the PMOS transistor Mll through resistors R15 and R16 respectively, and an emitter grounded.

With reference to FIG. 3, the operation of the current control circuit will be described below. A voltage drop in the resistor R11 will be hereinafter referred to as V(R11) . When an overcurrent flows from the power source to the load, the V(R11) is increased so that the PNP transistor Q11 is turned ON to raise a voltage on a point C. Consequently, an ON-state resistance of the PMOS transistor M11 is increased so that a current flowing from the power source to the load is decreased. A value of a current flowing from the power source to the load is limited to V(R1)=0.7 V (volt) (hereinafter referred to as V) through a feedback group including the resistor R11, the PNP transistor Q11 and the PMOS transistor M11. A drain current of the PMOS transistor M11 obtained at this time is schematically shown in FIG. 4.

A base-emitter voltage at which the PNP transistor Q11 is turned ON is set to 0.7 V. For example, if V(R1) is set to be 0.1V, when a load current is in a normal state, an overcurrent flowing to the load is limited to seven times as great as that in the normal state.

A first problem is as follows. In a conventional current control circuit, a difference between a load current value in a normal state and a current value obtained when the overcurrent is limited is great and the limited overcurrent continuously flows to the load. Therefore, the PMOS transistor M11 should have a great allowable loss. The allowable loss of a power transistor is mainly determined by performance for radiating an energy to be consumed by an element. Therefore, if the power transistor having a great allowable energy, a mounting space is increased so that an apparatus becomes large-sized.

A second problem is that the limited overcurrent continuously flows in the conventional current control circuit. Consequently, the load is damaged more greatly. The reason is that the power consumption in the load is increased because the current flows continuously.

SUMMARY OF THE INVENTION

It is an object of the present invention to detect an overcurrent of a load and to disconnect a current path to the load with few elements, thereby reducing a mounting space for a current control circuit and minimizing the damage of the load.

A first aspect of the present invention is a current control circuit comprising; a pair of input terminals for connecting a DC power source which outputs a prescribed output voltage, a pair of output terminals for connecting a load, a first resistor, one end of which is connected to one of the input terminals, a PNP transistor, for detecting an overcurrent flowing to the load, having an emitter connected to an one end of the first resistor and a base connected to the other end of the first resistor, a PMOS transistor, for controlling connection and disconnection between the DC power source and the load, having a source connected to the other end of the first resistor and a drain connected to one of the output terminals, a time constant circuit comprising a second resistor and a capacitor which are provided between a collector of the PNP transistor and the ground, and a hysteresis comparator, to which a voltage obtained by the time constant circuit is applied, for controlling a gate of the PMOS transistor.

A second aspect of the present invention is that an NPN transistor for controlling the PMOS transistor, a third resistor provided between a collector of the NPN transistor and the source of the PMOS transistor, a fourth resistor provided between a collector of the NPN transistor and the gate of the PMOS transistor, and a diode having an anode connected to an output of the hysteresis comparator and a cathode connected to the gate of the PMOS transistor, are provided.

As a first effect of the present invention, a switching transistor for turning ON/OFF the power path of the current control circuit can have a minimum allowable loss. Consequently, a mounting space of the current control circuit can be reduced.

As a second effect, the total amount of an energy of the overcurrent flowing to the load can be reduced considerably. Therefore, the load is less damaged.

The reason is as follows. When an overcurrent is detected, the current path is disconnected. For some period, therefore, a current temporarily flows to the load every constant time. A period for which the current path is maintained to be disconnected can be increased. Consequently, the power consumption of the load can be reduced.

DESCRIPTION OF THE PREFERRED EMBODIMENTS

The embodiment of the present invention will be described below in detail.

Figure 1:
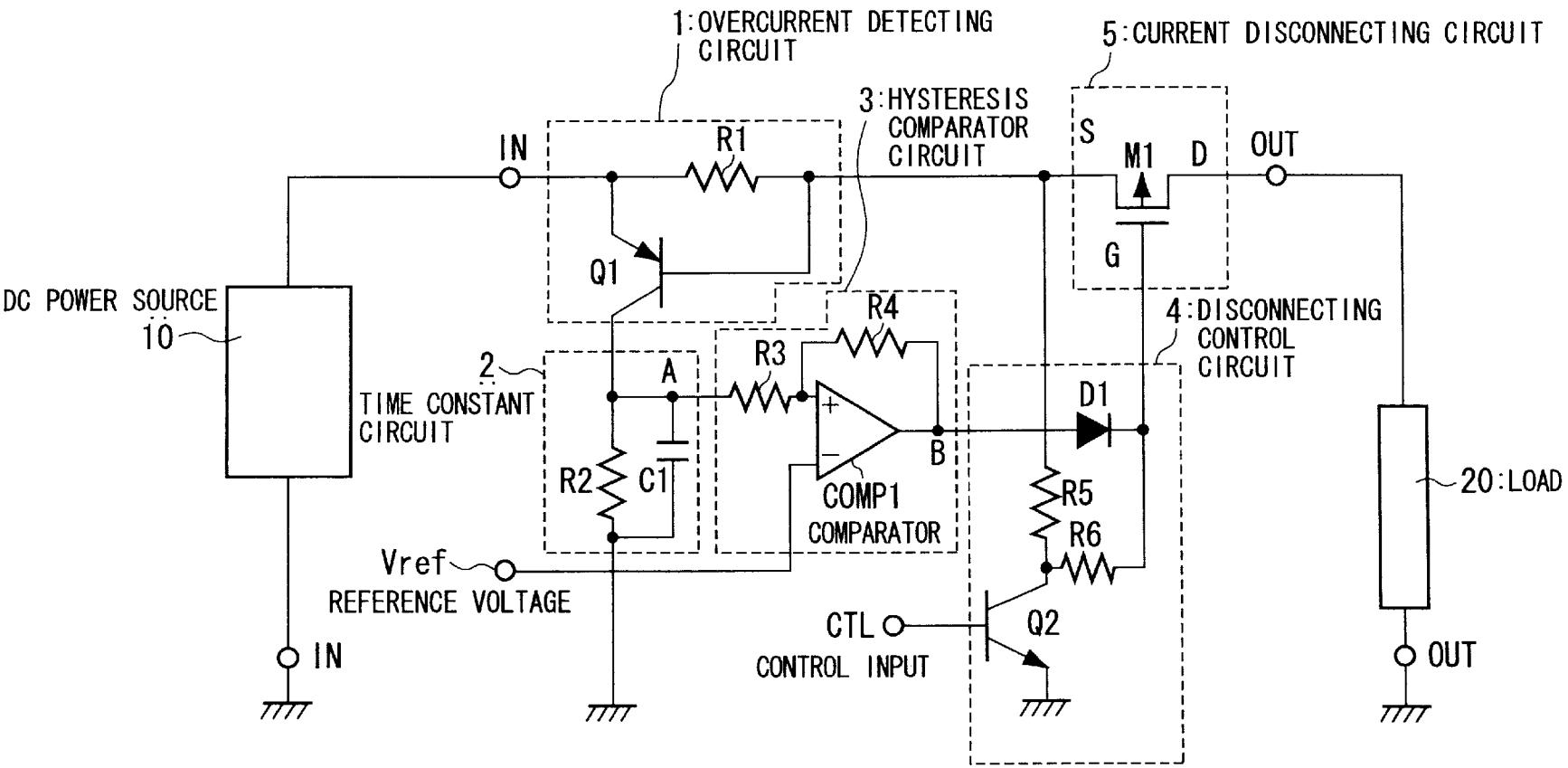
FIG. 1 is a circuit diagram showing an embodiment of the present invention.

FIG. 1 shows a current control circuit according to the first embodiment of the present invention. The current control circuit comprises a pair of input terminals IN for connecting the DC power source 10 which outputs a prescribed output voltage, a pair of output terminals OUT for connecting the load 20, a first resistor Ri, one end of which is connected to one of the input terminals, a PNP transistor Q1, for detecting an overcurrent flowing to the load 10, having an emitter connected to an one end of the first resistor R1 and a base connected to the other end of the first resistor R1, a PMOS transistor M1, for controlling connection and disconnection between the DC power source 10 and the load 20, having a source connected to the other end of the first resistor R1 and a drain connected to one of the output terminals, a time constant circuit 2 comprising a second resistor R2 and a capacitor Cl which are provided between a collector of the PNP transistor Q1 and the ground, and a hysteresis comparator 3, to which a voltage obtained by the time constant circuit 2 is applied, for controlling a gate of the PMOS transistor M1.

The current control circuit of the present invention further comprises an NPN transistor Q2 for controlling the PMOS transistor M1, a third resistor R5 provided between a collector of the NPN transistor Q2 and the source of the PMOS transistor M1, a fourth resistor R6 provided between a collector of the NPN transistor Q2 and the gate of the PMOS transistor M1, and a diode D1 having an anode connected to an output of the hysteresis comparator 3 and a cathode connected to the gate of the PMOS transistor M1.

In more detail, the current control circuit includes a resistor R1 having one end to which the input terminal IN for inputting the output of the power source is connected, a PMOS transistor M1 having a source S connected to the other end of the resistor R1 and a drain D connected to an output terminal OUT to be coupled to a load, a PNP transistor Q1 having an emitter connected to the one end of the resistor R1 and a base connected to the other end of the resistor R1 and a collector connected to one end of the parallel circuit 2 having a resistor R2 and a capacitor C1, the parallel circuit 2 having the other end grounded, a comparator COMPI having a positive input connected to one end of the parallel circuit 2 through a resistor R3, a negative input connected to an external reference voltage Vref and a resistor R4 provided between an output of the comparator COMP1 and the positive input of the comparator COMP1, an NPN transistor Q2 having a base connected to an external control input CTL and a collector connected to the source S of the PMOS transistor M1 through a resistor R5 and to the gate G of the PMOS transistor M1 through a resistor R6, and a diode D1 having an anode connected to an output of the comparator COMP1 and a cathode connected to the gate G of the PMOS transistor M1.

The input terminal IN, the output terminal OUT, the reference voltage Vref and the control input CTL are terminals for external connection, and the COMP1 indicates a comparator, Q1 and Q2 indicate bipolar transistors, M1 indicates a PMOS transistor, D1 indicates a diode, R1 to R6 indicate resistors, and C1 indicates a capacitor.

The PMOS transistor M1 has a threshold voltage higher than 1 V and lower than (Vcc−0.7 volt), where Vcc is DC power supply voltage of the comparator COMP1. The power source 10 is connected to the input terminal IN and the load 20 is connected to the output terminal OUT, and the PMOS transistor M1 controls the connection and disconnection between the power source 10 and the load 20. A voltage of approximately Vcc/2 is applied to the reference voltage Vref.

CTL indicates a control input for turning ON or OFF the PMOS transistor M1. When a high level is given to the control input CTL from the outside, a gate terminal of the PMOS transistor M1 is set to have a low level if a point B (the output of the comparator COMPL) has a low level. Consequently, the PMOS transistor M1 is turned ON so that a current can flow from the input terminal IN to the output terminal OUT. To the contrary, if the point B has the high level, the gate G of the PMOS transistor M1 is set to have a voltage (Vcc−0.7 V) . Consequently, the PMOS transistor M1 is turned OFF so that the current does not flow to the output terminal OUT.

When the low level is given from the outside to the control input CTL, the NPN transistor Q2 is turned OFF. Therefore, the collector of the NPN transistor Q2 is set to have a Vcc level so that the diode D1 is turned OFF. Irrespective of the level on the point B, the gate G of the PMOS transistor M1 has the Vcc level and the PMOS transistor M1 is turned OFF. Thus, the current flow from the input terminal IN to the output terminal OUT is blocked.

Figure 3:
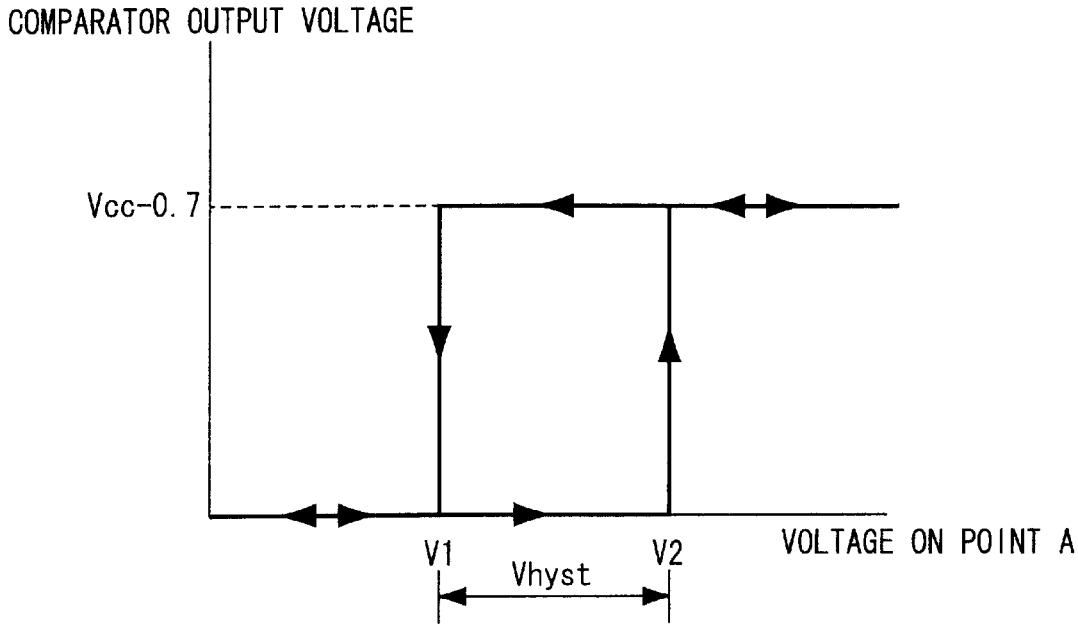
FIG. 3 is a chart showing an input/output characteristic of a comparator according to the present invention.
Figure 4:
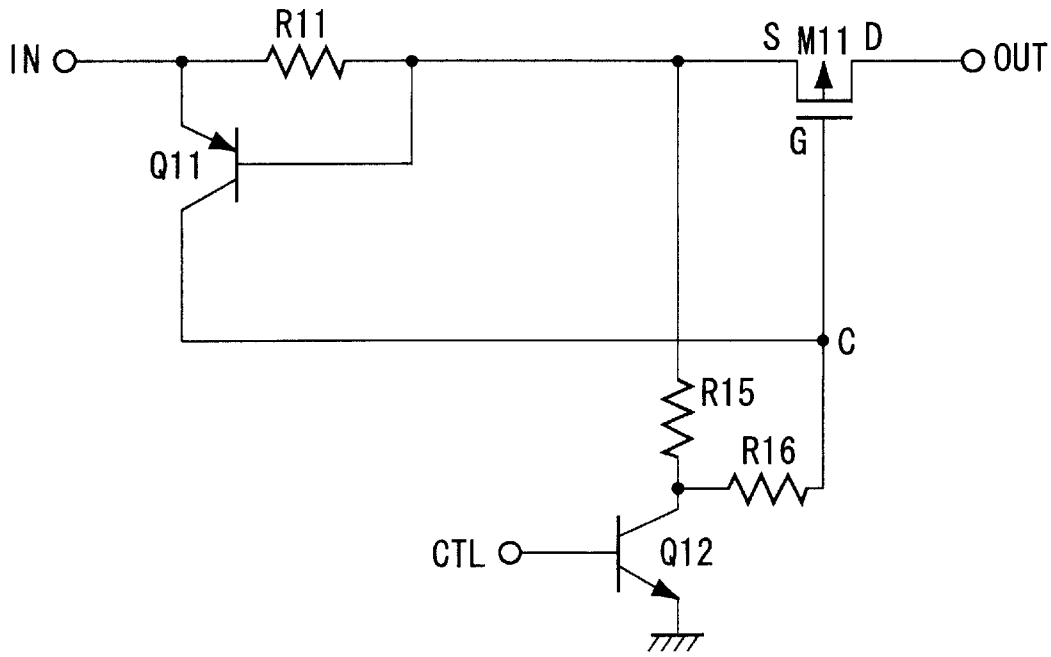
Fig. 4 PRIOR ART
FIG. 4 is a circuit diagram showing a conventional current control circuit.
Figure 5:
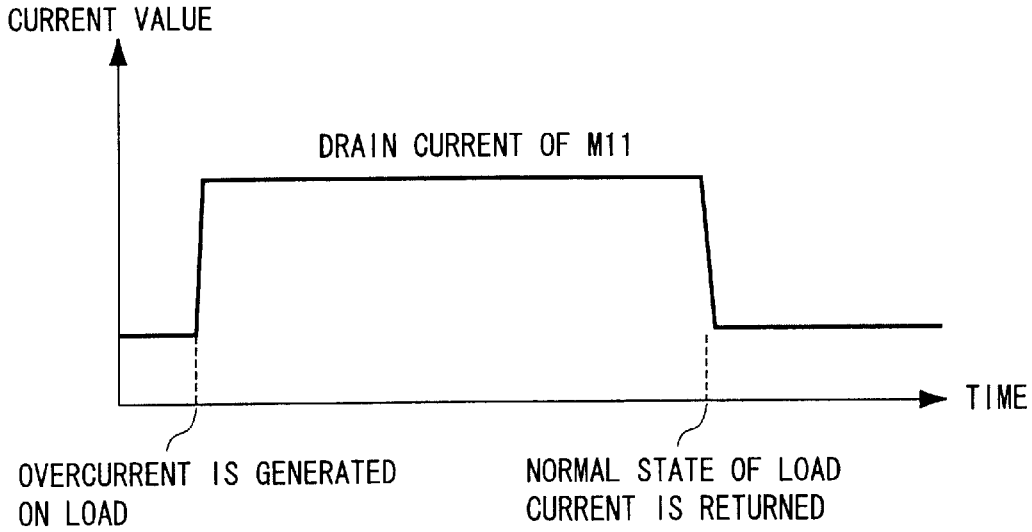
Fig. 5 PRIOR ART
FIG. 5 is a waveform diagram showing a drain current of a switching transistor of the conventional current control circuit.

R1 is a resistor for detecting a current flowing to the load. If an overcurrent flows, the PNP transistor Q1 is turned ON. R2 is a load resistor of the PNP transistor Q1. When the PNP transistor Q1 is turned ON, the output of the comparator COMP1 is set to have the Vcc level if the capacitor C1 is charged to some extent. The resistors R3 and R4 give a hysteresis to the input/output characteristic of the comparator COMP1 as shown in FIG. 3.

The diode D1 has the anode connected to the output of the comparator COMP1 and the cathode connected to the gate of the PMOS transistor M1. When the output of the comparator COMP1 has a low level (approximately 0 V), the diode D1 is turned OFF or is reversely biased.

An operation according to the embodiment of the present invention will be described below with reference to FIGS. 1 and 2. For simplicity, values of the resistors R2, R3 and R4 are set to R2<<(R3+R4). More specifically, R2 is much smaller than a value of (R3+R4). Furthermore, it is assumed that the low level of the output of the comparator COMP1 is 0 V and the high level thereof is Vcc. In the normal operation state, the NPN transistor Q2 is turned ON so that the gate voltage of the PMOS transistor M1 is set to be approximately 0 V, and the PMOS transistor M1 is turned ON so that a current flows from the power source 10 to the load 20.

Figure 2:
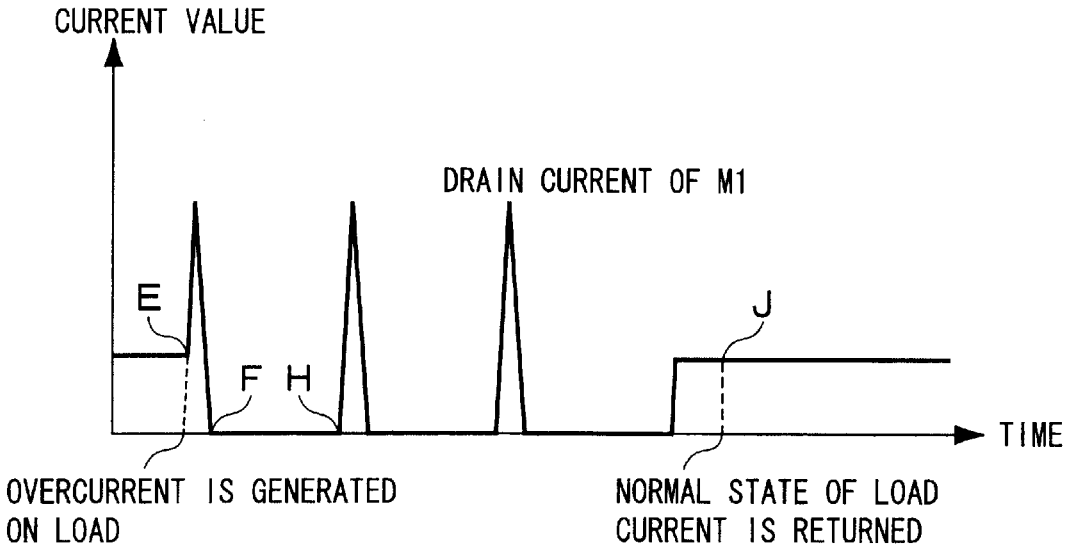
FIG. 2 is a waveform diagram showing a drain current of a switching transistor according to the embodiment of the present invention.

In the case in which a short-circuited abnormality is caused on the load and an overcurrent flows to the resistor R1, after a point E in FIG. 2, the PNP transistor Q1 is turned ON when the voltage drop of the resistor R1 is raised to be approximately 0.7 V. At the same time, the current flows to the resistor R2, and the capacitor C1 is charged. Consequently, a voltage on the point A is raised. In FIG. 3, when the voltage on the point A is raised from 0 V to V2, the output of the comparator COMP1 is changed from "LOW" to "HIGH". Since the drop in the voltage of the diode D1 is approximately 0.7 V, the gate voltage of the PMOS transistor M1 is set to (Vcc−0.7 V). Consequently, the PMOS transistor M1 is turned OFF so that the current flowing from the input terminal IN to the output terminal OUT is blocked as shown in a point F of FIG. 2.

When the PMOS transistor M1 is turned OFF, the voltage drop of the resistor R1 reaches 0 V. Consequently, the PNP transistor Q1 is turned OFF so that the capacitor C1 is discharged by the load resistor R2. Thus, a voltage on the point A is dropped. When the voltage on the point A reaches V1, the output of the comparator COMP1 is changed from "HIGH" to "LOW" so that the PMOS transistor M1 is turned ON. Consequently, a drain current of the PMOS transistor M1 starts to flow at a point H in FIG. 2 and is gradually increased.

If the voltage on the point A with a change of the output of the comparator COMP1 from the "LOW" to the "HIGH"

is represented by V2 and the voltage on the point A with a change of the output of the comparator COMP1 from the "HIGH" to the "LOW" is represented by Vl, an input hysteresis voltage Vhyst=V2−V1 with the output of the comparator COMP1 on the point A is obtained as follows, when Vref is Vcc/2, $$Vhyst=Vcc\times(R3/R4)$$

It is assumed that R2<<(R3+R4) is set. Therefore, it is supposed that only the load resistor R2 serves as a discharge path for the capacitor C1 and only the PNP transistor Q1 serves as a charge path for the capacitor C1. Accordingly, if the value of the load resistor R2 is set such that amount of a discharge current flowing from the capacitor C1 to the load resistor R2 when the PNP transistor Q1 is turned OFF is sufficiently smaller than amount of a charge current flowing to the capacitor C1 when the PNP transistor Q1 is turned ON, the drain current of the PMOS transistor M1 is obtained as shown in FIG. 2 while a short-circuited abnormality of the load is continuously maintained. Consequently, an intermittent current flows and a current rarely flows as in a disconnection state. Therefore, the total amount of an energy of the overcurrent flowing to the load can be reduced considerably. Therefore, it is possible to obtain the effect that a damage on the load can be reduced. In FIG. 2, while the drain current of the PMOS transistor M1 flows intermittently, an abnormal current is detected on the device side of the load. Then, a defective unit is exchanged with a non-defective unit. Thus, when a normal state is returned, a normal current continuously flows as shown in J of FIG. 2.

What is claimed is:

1. A current control circuit comprising:

a pair of input terminals for connecting a DC power source which outputs a prescribed output voltage, a pair of output terminals for connecting a load, a first resistor, one end of which is connected to one of said input terminals, a PNP transistor, for detecting an overcurrent flowing to said load, having an emitter connected to an one end of said first resistor and a base connected to the other end of said first resistor, a PMOS transistor, for controlling connection and disconnection between said DC power source and said load, having a source connected to the other end of said first resistor and a drain connected to one of said output terminals, a time constant circuit comprising a second resistor and a capacitor which are provided between a collector of said PNP transistor and the ground, and a hysteresis comparator, to which a voltage obtained by said time constant circuit is applied, for controlling a gate of said PMOS transistor.

2. A current control circuit according to claim 1, further comprising:

an NPN transistor for controlling said PMOS transistor, a third resistor provided between a collector of said NPN transistor and said source of said PMOS transistor, a fourth resistor provided between a collector of said NPN transistor and said gate of said PMOS transistor, and a diode having an anode connected to an output of said hysteresis comparator and a cathode connected to said gate of said PMOS transistor.

3. A current control circuit comprising:

a pair of input terminals for connecting a DC power source which outputs a prescribed output voltage, a pair of output terminals for connecting a load, a first resistor, one end of which is connected to one of said input terminals, a PNP transistor, for detecting an overcurrent flowing to said load, having an emitter connected to an one end of said first resistor and a base connected to the other end of said first resistor, a PMOS transistor, for controlling connection and disconnection between said DC power source and said load, having a source connected to the other end of said first resistor and a drain connected to one of said output terminals, a time constant circuit comprising a second resistor and a capacitor which are provided between a collector of said PNP transistor and the ground, a hysteresis comparator for comparing a voltage obtained by said time constant circuit with a reference voltage provided for said hysteresis comparator, an NPN transistor for controlling said PMOS transistor, a third resistor provided between a collector of said NPN transistor and said source of said PMOS transistor, a fourth resistor provided between a collector of said NPN transistor and said gate of said PMOS transistor, and a diode having an anode connected to an output of said hysteresis comparator and a cathode connected to said gate of said PMOS transistor.

4. A current control circuit comprising:

a pair of input terminals for connecting a DC power source which outputs a prescribed output voltage, a pair of output terminals for connecting a load, a first resistor, one end of which is connected to one of said input terminals, a PNP transistor, for detecting an overcurrent flowing to said load, having an emitter connected to an one end of said first resistor and a base connected to the other end of said first resistor, a PMOS transistor, for controlling connection and disconnection between said DC power source and said load, having a source connected to the other end of said first resistor and a drain connected to one of said output terminals, a time constant circuit comprising a second resistor and a capacitor which are provided between a collector of said PNP transistor and the ground, and the hysteresis comparator circuit comprising a comparator, for controlling a gate of said PMOS transistor, having a negative input to which an external reference voltage is applied, a third resistor having both ends, one of which is connected to said collector of said PNP transistor and the other one of which is connected to a positive input of said comparator, and a fourth resistor having both ends, one of which is connected to a positive input of said comparator and the other one of which is connected to an output of said comparator.

5. A current control circuit comprising:

a pair of input terminals for connecting a DC power source which outputs a prescribed output voltage, a pair of output terminals for connecting a load, a first resistor, one end of which is connected to one of said input terminals, a PNP transistor, for detecting an overcurrent flowing to said load, having an emitter connected to an one end of said first resistor and a base connected to the other end of said first resistor, a PMOS transistor, for controlling connection and disconnection between said DC power source and said load, having a source connected to the other end of said first resistor and a drain connected to one of said output terminals, a time constant circuit comprising a second resistor and a capacitor which are provided between a collector of said PNP transistor and the ground, the hysteresis comparator circuit comprising a comparator having a negative input to which an external reference voltage is applied, a third resistor having both ends, one of which is connected to said collector of said PNP transistor and the other one of which is connected to a positive input of said comparator, and a fourth resistor having both ends, one of which is connected to a positive input of said comparator and the other one of which is connected to an output of said comparator, an NPN transistor for controlling said PMOS transistor, a third resistor provided between a collector of said NPN transistor and said source of said PMOS transistor, a fourth resistor provided between a collector of said NPN transistor and said gate of said PMOS transistor, and a diode having an anode connected to an output of said comparator and a cathode connected to said gate of said PMOS transistor.

* * * * *

UNITED STATES PATENT AND TRADEMARK OFFICE

CERTIFICATE OF CORRECTION

PATENT NO. : 6,384,584 B2
DATED : May 7, 2002
INVENTOR(S) : Kazuhiro Sugano

It is certified that error appears in the above-identified patent and that said Letters Patent is hereby corrected as shown below:

Column 1,
Line 22, delete “MII” insert -- M11 --

Column 2,
Line 67, delete “Ri” insert -- R1 --

Column 3,
Line 35, delete “COMPI” insert -- COMP1 --;
Line 67, delete “COMPL” insert -- COMP1 --

Signed and Sealed this

Third Day of December, 2002

JAMES E. ROGAN
*Director of the United States Patent and Trademark Office*